US011468821B2

(12) United States Patent
Hsieh

(10) Patent No.: US 11,468,821 B2
(45) Date of Patent: Oct. 11, 2022

(54) SOURCE DRIVING CIRCUIT AND OPERATING METHOD THEREOF

(71) Applicant: Novatek Microelectronics Corp., Hsinchu (TW)

(72) Inventor: Cheng-Tsu Hsieh, Taoyuan (TW)

(73) Assignee: Novatek Microelectronics Corp., Hsinchu (TW)

( * ) Notice: Subject to any disclaimer, the term of this patent is extended or adjusted under 35 U.S.C. 154(b) by 40 days.

(21) Appl. No.: 16/995,764

(22) Filed: Aug. 17, 2020

(65) Prior Publication Data

US 2022/0051607 A1 Feb. 17, 2022

(51) Int. Cl.
*G09G 3/20* (2006.01)

(52) U.S. Cl.
CPC ... *G09G 3/2092* (2013.01); *G09G 2310/0267* (2013.01); *G09G 2310/0275* (2013.01); *G09G 2310/0291* (2013.01)

(58) Field of Classification Search
CPC ..... G09G 3/2092; G09G 2310/0267; G09G 2310/0275; G09G 2310/0291
See application file for complete search history.

(56) References Cited

U.S. PATENT DOCUMENTS 5,917,471 A * 6/1999 Choi ..... G09G 3/2007 345/690
2007/0262941 A1* 11/2007 Jan ..... G09G 3/3614 345/96
2009/0079683 A1* 3/2009 Ding ..... G09G 3/3688 345/89
2015/0061979 A1* 3/2015 Suzuki ..... G09G 3/3233 345/76
2017/0270863 A1* 9/2017 Suh ..... G09G 3/3688

* cited by examiner

*Primary Examiner* — Chanh D Nguyen
*Assistant Examiner* — Ngan T. Pham-Lu
(74) *Attorney, Agent, or Firm* — JCIPRNET

(57) ABSTRACT

The disclosure provides a source driving circuit adapted to a display panel. The source driving circuit includes a data channel and a control circuit. The data channel is configured to be coupled to a data line of the display panel and drive the data line of the display panel sequentially according to first display data and second display data. The first display data corresponds to a first scan line of the display panel, and the second display data corresponds to a second scan line of the display panel next to the first scan line of the display panel. The control circuit is coupled to the data channel and is configured to control a time point that the data channel outputs the second display data according to similarity between the first display data and the second display data.

29 Claims, 9 Drawing Sheets

SOURCE DRIVING CIRCUIT AND OPERATING METHOD THEREOF

BACKGROUND

Technical Field

The disclosure relates to a source driving circuit, and in particular, relates to a source driving circuit capable of controlling an output time point of display data.

Description of Related Art

In a driver IC of a display panel, switching of the output gray-scale data may cause the gamma reference voltage in the driver IC to be disturbed, so that a recovery time is required. Nevertheless, in this recovery time, the disturbance still exists, and the crosstalk interference phenomenon occurs in the gray-scale data that is not required be switched consequentially.

FIG. 1A is a schematic diagram illustrating a display screen having a crosstalk interference phenomenon, and FIG. 1B is a schematic diagram illustrating waveforms of gray-scale data during switching. With reference to FIG. 1A, a background color of a display screen 100 is black (schematically represented by uniform black dots in FIG. 1A), and corresponding gray-scale data is, for example, +255 (or −255). A region that is nearly white is provided in the middle of the black background color, and the corresponding gray-scale data is, for example, +5 (or −5). The gray-scale data transmitted through a channel Ch1 when a scan line scans a region R1 is changed from +255 to +5. Similarly, the gray-scale data transmitted through a channel Ch2 is changed from −255 to −5 in the region R1. Simply put, the gray-scale data transmitted through channels Ch1 to Ch640 in the region R1 is transited (that is, the gray-scale data is switched), and gray-scale data transmitted through all channels after the channel Ch640 (including the channel Ch960) should remain black. Nevertheless, as affected by the transition of the channels Ch1 to Ch640, the gray-scale voltages transmitted through all channels after the channel Ch640 are all affected consequentially. As such, in a region R2, unwanted light lines that are easy to be recognized by human eyes appear, which is the crosstalk interference phenomenon. Actually, transition of the channels Ch1 to Ch640 in a region R3 may also affect the gray-scale voltages transmitted through all the channels after the channel Ch640. As such, a dark line that is difficult for human eyes to recognize appears in a region R4.

With reference to FIG. 1A and FIG. 1B together, channels Ch1, Ch2, and Ch960 respectively transmit gray-scale data $S_{Ch1}$, $S_{Ch2}$, and $S_{Ch960}$. In a region R, the gray-scale data $S_{Ch1}$ is changed from +255 to +5, the gray-scale data $S_{Ch2}$ is changed from −255 to −5, and the gray-scale data $S_{Ch960}$ should ideally be kept at −5. Nevertheless, actually, as affected by instantaneous loading of the current, the source voltage generating the gray-scale data may be interfered. The voltage value of the gray-scale data $S_{Ch960}$ drops (see region 101). Note that for ease of description and presenting of a concise figure, FIG. 1B only illustrates the changes of signal curves of the channels Ch1, Ch2, and Ch960 along with time. Actually, in addition to the gray-scale voltage transmitted through the channel Ch960, the gray-scale voltages transmitted through all channels after the channel Ch640 are all affected.

To solve the foregoing problem, the recovery speed of the gamma reference voltage may be accelerated (i.e., decreasing the recovery time) by increasing the binding points of the gamma reference voltage or increasing the current of the gamma reference resistance string. Nevertheless, through the above manners, the analog current is increased, so that the analog power consumption rises. Therefore, a solution capable of preventing the gray-scale data not required to be switched from being affected and the analog power consumption from rising is required to be provided.

SUMMARY

The disclosure provides a source driving circuit capable of preventing gray-scale data from being interfered.

According to an embodiment of the disclosure, a source driving circuit includes a data channel and a control circuit. The data channel is configured to be coupled to a data line of the display panel and drive the data line of the display panel sequentially according to first display data and second display data. The first display data corresponds to a first scan line of the display panel, and the second display data corresponds to a second scan line of the display panel next to the first scan line of the display panel. The control circuit is coupled to the data channel and is configured to control a time point that the data channel outputs the second display data according to similarity between the first display data and the second display data.

According to an embodiment of the disclosure, a source driving circuit includes a data channel and a control circuit. The data channel is configured to be coupled to a data line of the display panel and drive the data line of the display panel sequentially according to first display data and second data. The first display data corresponds to a first scan line of the display panel, and the second display data corresponds to a second scan line next to the first scan line of the display panel. The control circuit is coupled to the data channel and is configured to determine whether to cause a delay time for delaying a time point that the data channel outputs the second display data according to similarity between the second display data and the first display data.

According to an embodiment of the disclosure, an operating method of a source driving circuit includes the following steps. A data line of the display panel is sequentially driven according to first display data and second display data. Whether to cause a delay time for delaying a time point that the second display data is output is determined according to similarity between the second display data and the first display data.

To sum up, in the disclosure, the first display data and the second display data are compared, so as to determine that whether the output time point at which the second display data is output is delayed. In this way, the time point at which the second display data is output may avoid the time period during which the source voltage may be interfered.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1A:
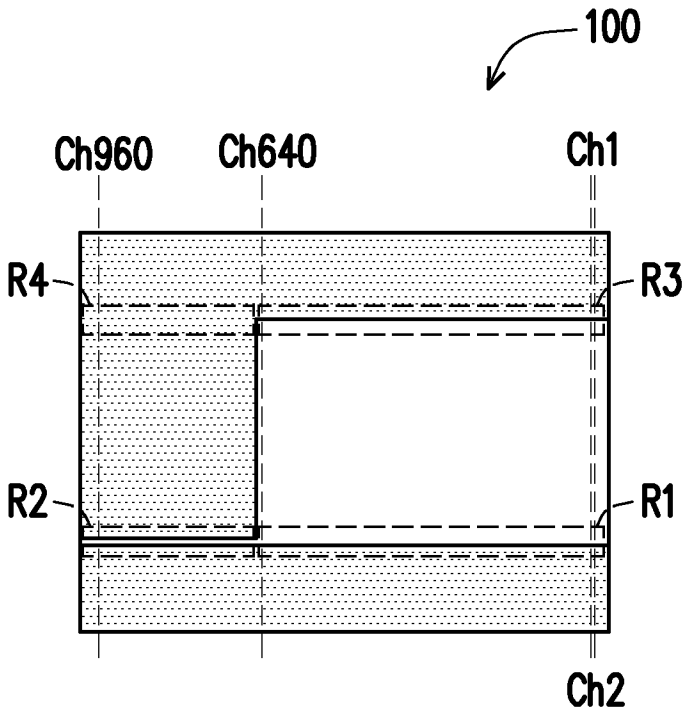
FIG. 1A is a schematic diagram illustrating a display screen having a crosstalk interference phenomenon.

Descriptions of the disclosure are given with reference to the exemplary embodiments illustrated by the accompanying drawings. Wherever possible, the same reference numbers are used in the drawings and the description to refer to the same or like parts.

Figure 2:
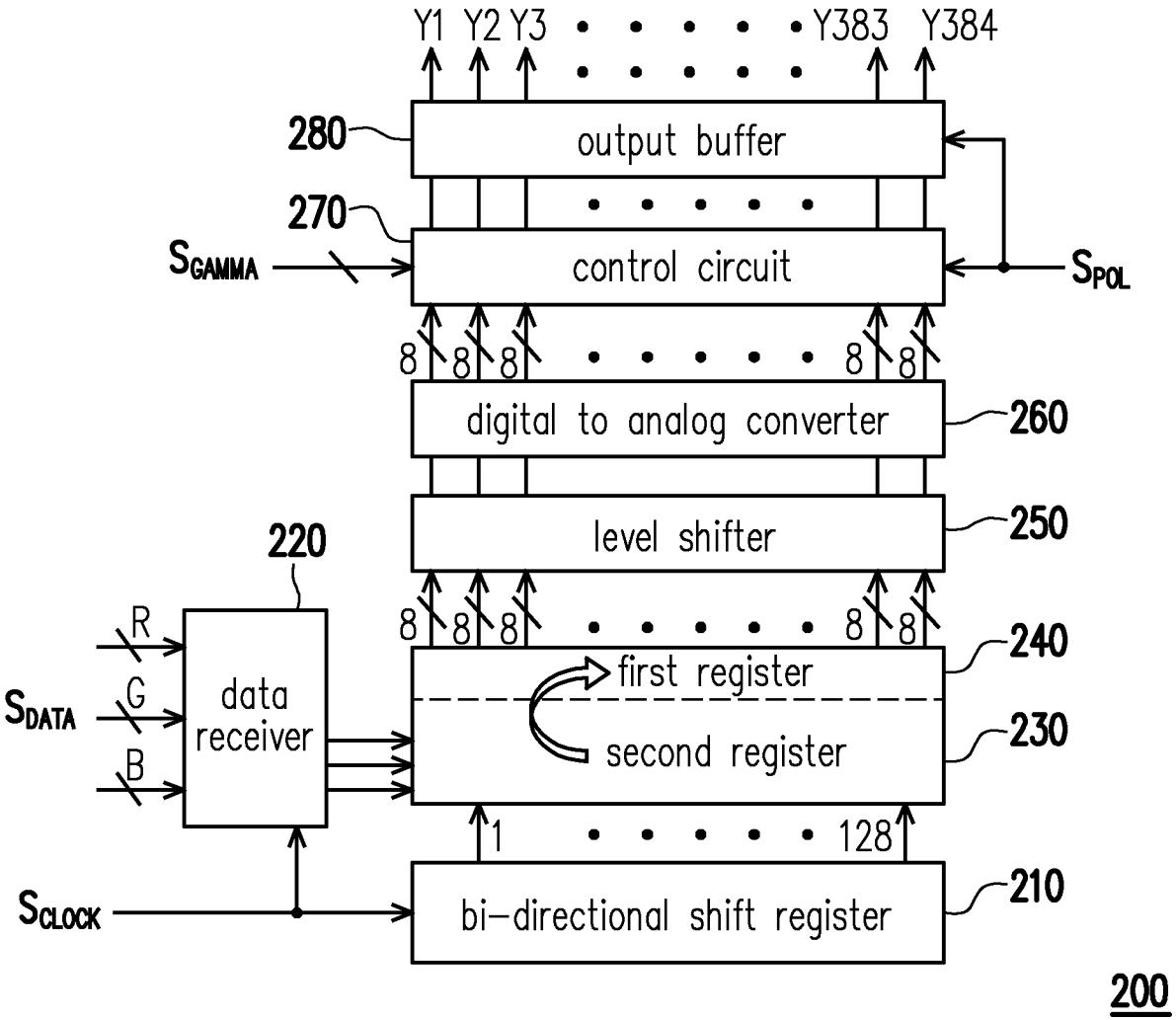
FIG. 2 is a schematic diagram illustrating blocks of a source driving circuit provided by the disclosure.

FIG. 2 is a schematic diagram illustrating blocks of a source driving circuit provided by the disclosure. With reference to FIG. 2, a source driving circuit 200 includes a bi-directional shift register 210, data receiver 220, a first register 230, a second register 240, a level shifter 250, digital to analog converter 260, control circuit 270, and an output buffer 280. Among the foregoing circuits, except the control circuit 270, the rest of the circuits belong to the scope of the related art, and a person of ordinary skill in the art should be familiar with the functions thereof. Therefore, the rest of the circuits are briefly described as follows except the control circuit 270.

With reference to FIG. 2, a clock signal SCLOCK is provided to both the bi-directional shift register 210 and the data receiver 220. The data receiver 220 receives gray-scale data SDATA (hereinafter referred to as first display data, including, for example, gray-scale data for red R, green G, and blue B) at a first time point. The first register 230 is configured to store the first display data. Next, the first display data is moved from the first register 230 to the second register 240 for storing. At this time, the first register 230 stores grayscale data SDATA (hereinafter referred to as second display data) received by the data receiver 220 at a second time point. The second time point is right after the first time point in a time sequence. In terms of a structure of a pixel circuit of a panel, the first display data is equivalent to gray-scale data transmitted by a data channel (e.g., a channel Ch1 shown in FIG. 1A) corresponding to a first scan time sequence, and the second display data is equivalent to gray-scale data transmitted by the same data channel corresponding to a second scan time sequence. The second scan time sequence is right after the first scan time sequence.

In the relate art, the first display data is sequentially transmitted by the second register 240, the level shifter 250, and the digital to analog converter (also called as a D/A converter or a DAC for short) 260, and data output (i.e., data Y1 to Y384 is output through the data channel to the corresponding data line of the panel) is performed by the output buffer 280. A gamma reference voltage $S_{GAMMA}$ is provided to the digital to analog converter 260. Polarity data SPOL is provided to both the digital to analog converter 260 and the output buffer 280. In the disclosure, the control circuit 270 may be disposed to control a output time of the output buffer 280, so as to control a time point that the data channel outputs the second display data according to similarity between the first display data and the second display data. More specifically, the control circuit 270 may determine whether to delay the time point at which the second display data is output according to polarity identicality of and data similarity between the first display data and the second display data. In this way, the time point at which the second display data is output may avoid a time period during which a source voltage may be interfered. Implementation of the control circuit 270 is described in detail below through an operational flow chart.

In some embodiments, a time length of the delay time is a fixed when the second display data and the first display data are similar. For example, the time length of the delay time is the same even when the second display data is more similar to the first display data.

In some other embodiments, a time length of the delay time depends upon similarity degree between the second display data and the first display data. For example, the time length of the delay time is greater when the second display data is more similar to the first display data.

Figure 3:
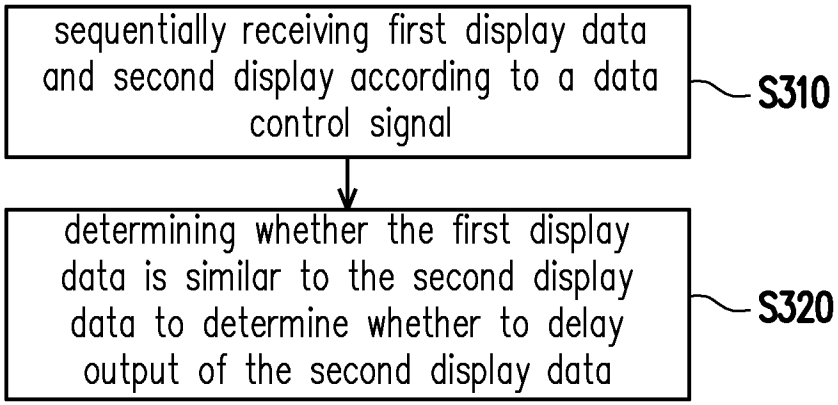
FIG. 3 is a flow chart illustrating steps of an operating method of the source driving circuit according to an embodiment of the disclosure.

FIG. 3 is a flow chart illustrating steps of an operating method of the source driving circuit according to an embodiment of the disclosure. With reference to FIG. 3, in step S310, the data channel sequentially drives a data line of the display panel according to the first display data and the second display data. Herein, the first display data corresponds to a first scan line of the display panel, and the second display data corresponds to a second scan line of the display panel next to the first scan line of the display panel. This means that the second display data is right after the first display data in a transmission order. In step S320, the control circuit 270 determines whether to cause a delay time for delaying the time point that the second display data is output according to the data similarity between the second display data and the first display data.

Specifically, in step S320, the control circuit 270 may compare polarity and bit values between the first display data and the second display data. When the polarity of the first display data is identical to the polarity of the second display data and an amount of the same bit values of the first display data and the second display data is equal to or greater than a threshold, the control circuit 270 determines that the first display data and the second display data are similar. In one implementation, when the polarity of the first display data is identical to the polarity of the second display data (both are +, for example) and the bit values of the first display data are completely identical to the bit values of the second display data (both are "11111111", for example, meaning that the gray-scale data is 255), the control circuit 270 determines that the first display data and the second display data are similar. In another implementation, when 5 same bit values are provided between the first display data and the second display data (e.g., the first display data is "11111111" and the second display data is "11111000"), the control circuit 270 determines that the first display data and the second display data are similar. In further another implementation, when 6 same bit values are provided between the first display data and the second display data (e.g., the first display data is "11111111" and the second display data is "11111100"), the control circuit 270 determines that the first display data and the second display data are similar. A designer may determine to what degree of similarity between the first display data and the second display data (all of the bit values are required to be the same or only part of the bit values are required to be the same) is to be configured to determine that the first display data and the second display data are similar according to actual needs. Moreover, when determining that the first display data and the second display data have the same polarity and exhibit data similarity, the control circuit 270 delays the time point that the second display time is output.

Briefly, taking FIG. 1A as an example, in the disclosure, the control circuit 270 learns that gray-scale data of a black background and gray-scale data of a white frame do not change along with the scan sequence through making a comparison. As such, the control circuit 270 may delay output time points of gray-scale data except regions R1 and R3 for a delay time, so that the output time points may avoid the time period during which the source voltage may be interfered. In this way, a crosstalk interference phenomenon that may occur is mitigated or eliminated. In the delay time, an output terminal of the data channel is in a floating state. Various exemplary implementations of delaying the output time points of the gray-scale data are provided as follows.

Figure 1B:
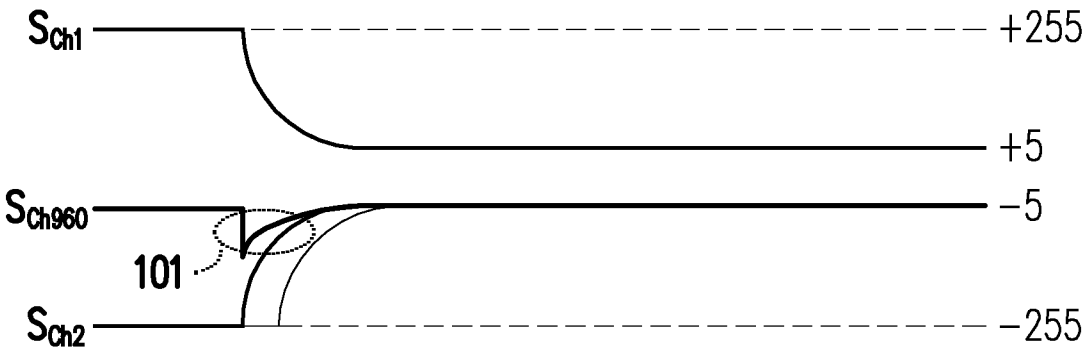
FIG. 1B is a schematic diagram illustrating waveforms of gray-scale data during switching.
Figure 4:
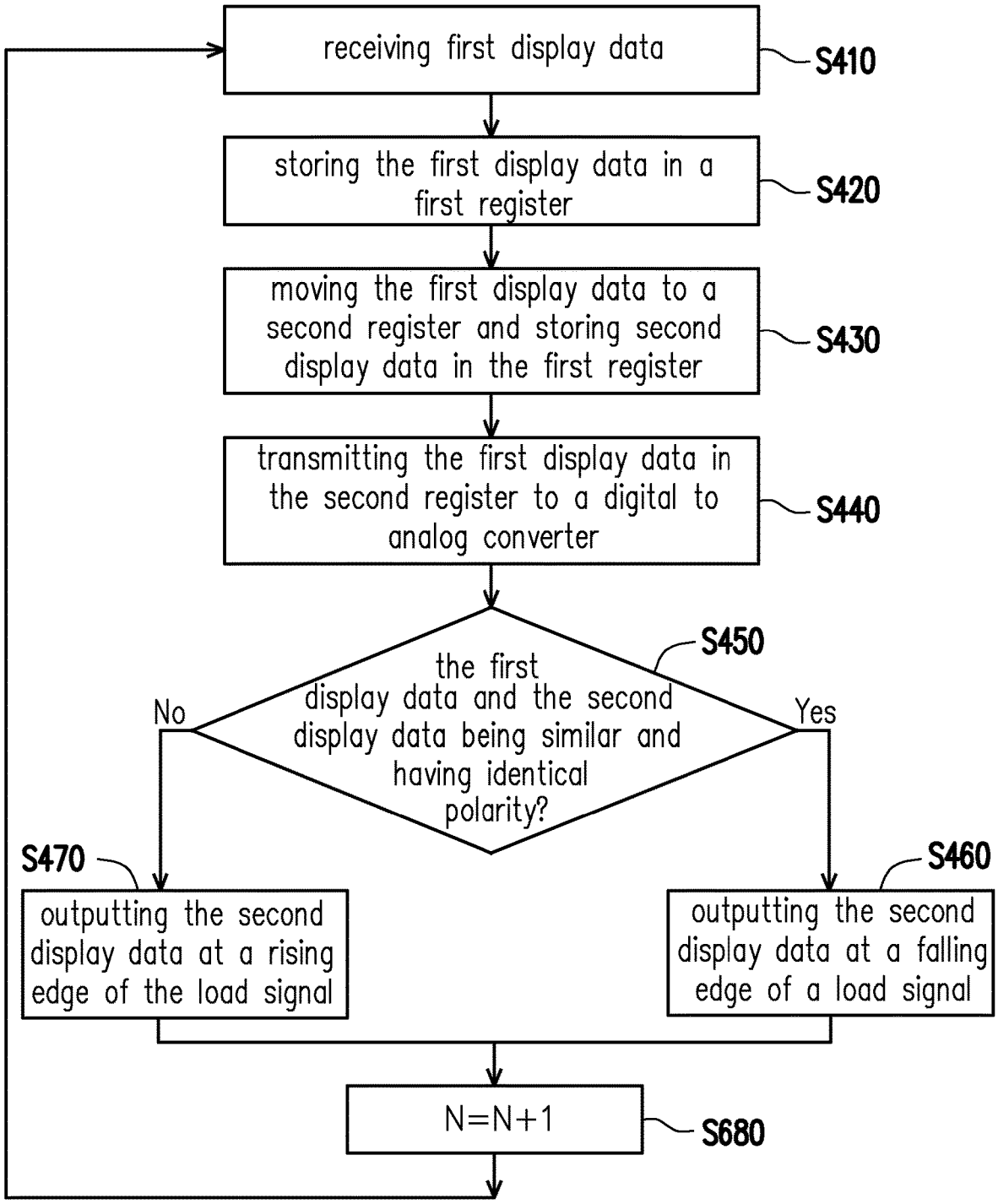
FIG. 4 is a flow chart illustrating steps of an operating method of the source driving circuit according to an embodiment of the disclosure.

FIG. 4 is a flow chart illustrating steps of an operating method of the source driving circuit according to an embodiment of the disclosure. With reference to FIG. 1 and FIG. 4 together, first, the source driving circuit 200 receives gray-scale data (may be treated as the first display data) corresponding to an $N^{th}$ scan sequence, where N is a positive integer (step S410). Next, the first display data is stored in the first register 230 (step S420). The first display data is then moved by the first register 230 to the second register 240 for storing, and the source driving circuit 200 receives gray-scale data (may be treated as the second display data) corresponding to an $N+1^{th}$ scan sequence and the gray-scale data (equivalent to the second display data) corresponding to an $N+1^{th}$ scan sequence is stored in the first register 230 (step S430). The first display data in the second register 240 is transmitted to the digital to analog converter 260 (step S440).

The control circuit 270 then determines that whether the first display data and the second display data are similar by determining, for example, whether the polarity of the first display data and the polarity of the second display data are identical by making a comparison and determines that whether data of the first display data and data of the second display data are identical (step S450). When the first display data and the second display data have identical polarity and have similar data, the control circuit 270 sets the first display data to be output at a predetermined output time point (e.g., to be output at a rising edge of a load (LD) signal) and sets the second display data to be output at a delay time later than the predetermined output time point (e.g., delayed to be output at a falling edge of the LD signal) (step S460). Conversely, when the first display data and the second display data are not similar, for example, having different polarity and/or have different data, the control circuit 270 sets the first display data and the second display data to be output at the predetermined output time point (e.g., to be output at the rising edge of the LD signal) (step S470). Finally, a value of N+1 is specified as a new N value (denoted as N=N+1), and step S410 is performed again (step S480). Note that the LD signal may be a control signal configured to control the time point that the display data is loaded or output to the data line. In other words, the LD signal can be a control signal for indicating a time point for the data channel to transmit or load or output display data to be displayed on each line of the display panel, which is known to a person of ordinary skill in the art.

Taking FIG. 1A as an example, regarding display data transmitted by a channel after a channel 640, the control circuit 270 provided by the disclosure may set display data corresponding to a first scan sequence to be output at the rising edge of the LD signal and set display data corresponding to a second scan sequence to be delayed to be output at the falling edge of the LD signal (because polarity and data of the display data of the first scan sequence and polarity and data of the display data of the second scan sequence are identical). Moreover, the control circuit 270 may control display data corresponding to a third scan sequence to be delayed to be output at the falling edge of the LD signal (because polarity and data of the display data corresponding to the second scan sequence and polarity and data of the display data corresponding to the third scan sequence are identical). That is, all the output time points of the similar or identical display data corresponding to the scan sequence later than the first scan sequence can be delayed.

In the above embodiments, when the first display data and the second display data have identical polarity and have similar data, the control circuit 270 sets the first display data and the second display data to be output at different types of edges of the same control signal (e.g., the LD signal). In more other embodiments, when the first display data and the second display data have identical polarity and have similar data, the control circuit 270 sets the first display data and the second display data to be output based on different control signals, which may be generated based on the LD signal. In such embodiments, the same or different types of edges of the different control signals can be used to trigger the display data to be output or loaded to the corresponding data lines.

Figure 5:
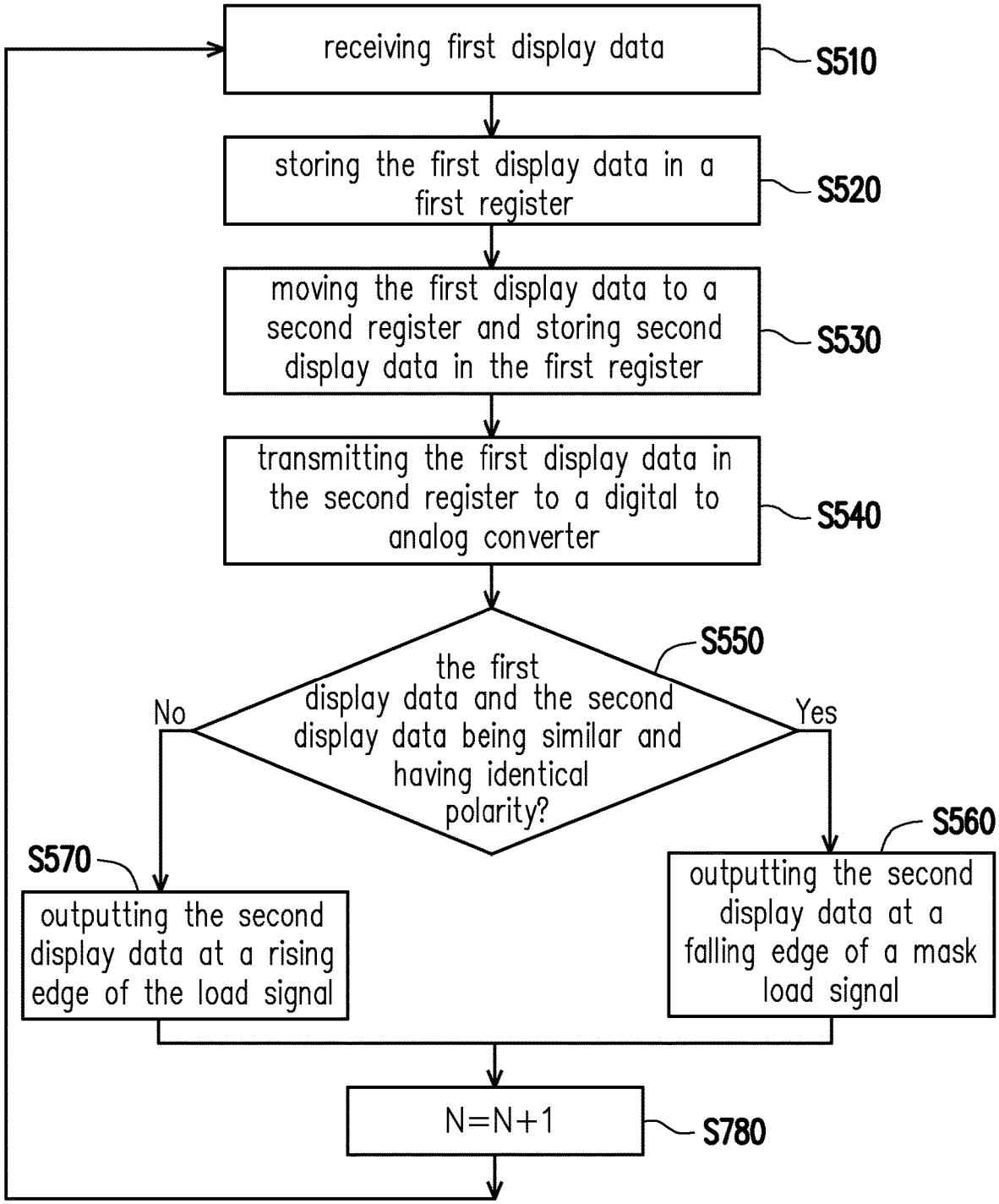
FIG. 5 is a flow chart illustrating steps of an operating method of the source driving circuit according to an embodiment of the disclosure.

FIG. 5 is a flow chart illustrating steps of an operating method of the source driving circuit according to an embodiment of the disclosure. Herein, steps S510 to S550 and S580 are similar to steps S410 to S450 and S480 in FIG. 4 respectively, and repeated description is thus not provided herein. With reference to FIG. 1 and FIG. 5 together, when the first display data and the second display data have identical polarity and have similar data, the control circuit 270 sets the first display data to be output at the predetermined rising edge of the LD signal and sets the second display data to be output at a falling edge of a mask LD signal (step S560). When the first display data and the second display data have different polarity and/or have dissimilar data, the control circuit 270 sets both the first display data and the second display data to be output at the rising edges of the LD signal (step S570).

Note that the mask LD signal is generated by the control circuit 270. Mask LD signal may be a signal generated by masking the LD signal. Due to the masking operation, time point of the rising edge of Mask LD signal may coincide with a time point of the rising edge of the LD signal, but a time point of the falling edge of is the mask LD signal may be after a time point of the falling signal of the LD signal. That is, rising starting points of the mask LD signal and the LD signal are the same, but a hold-up time (i.e., a pulse width) of a high voltage level of the mask LD signal is longer than a hold-up time (i.e., a pulse width) of a high voltage level of the LD signal. Since the pulse width of the LD signal is determined by the designer, in the case that a pulse terminal of the LD signal is too short to completely prevent the source voltage from being interfered, the operating manner shown in FIG. 5 may be adopted to prevent the source voltage from being interfered.

Figure 6:
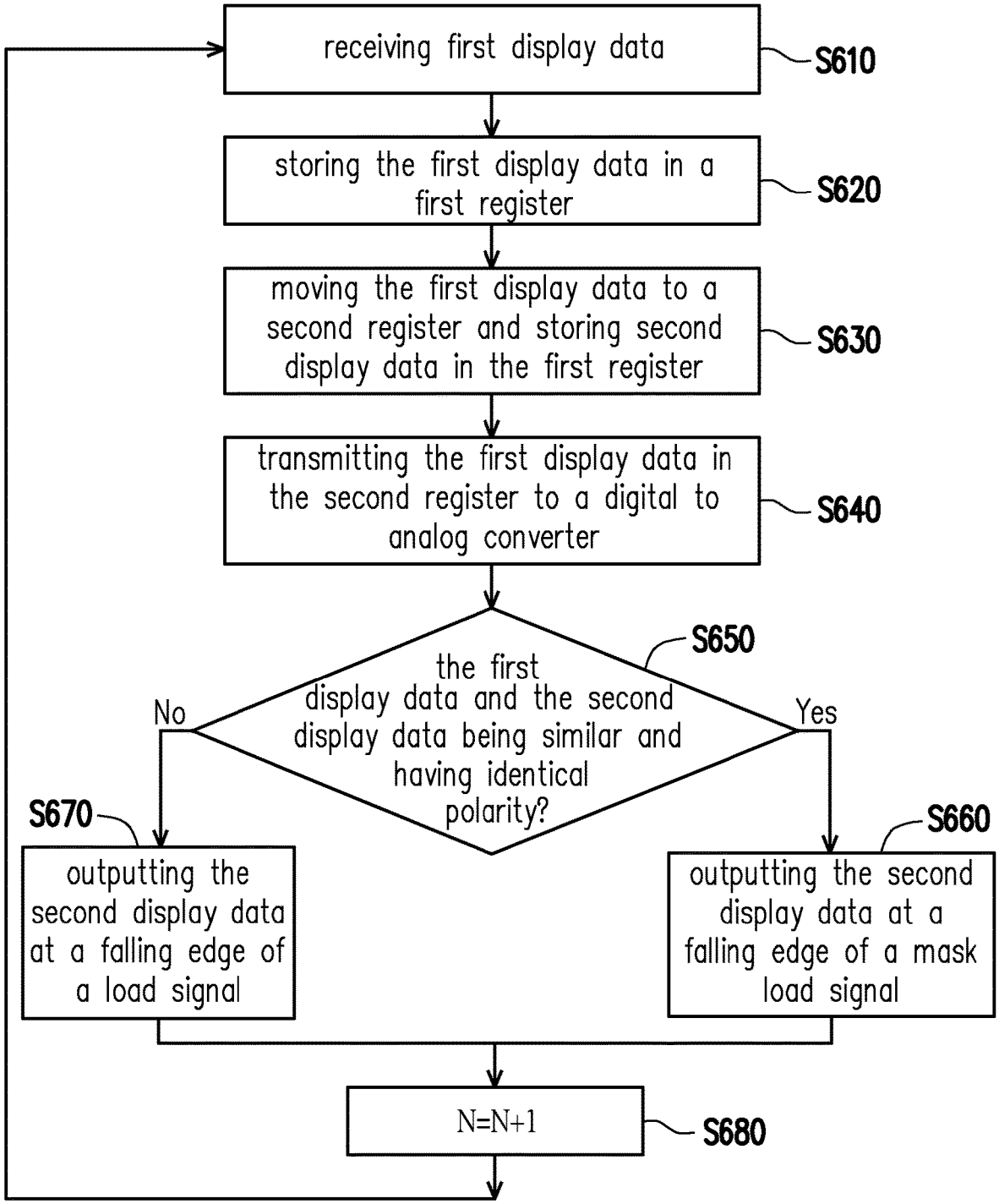
FIG. 6 is a flow chart illustrating steps of an operating method of the source driving circuit according to an embodiment of the disclosure.

FIG. 6 is a flow chart illustrating steps of an operating method of the source driving circuit according to an embodiment of the disclosure. Herein, steps S610 to S650 and S680 are similar to steps S410 to S450 and S480 in FIG. 4 respectively, and repeated description is thus not provided herein. With reference to FIG. 1 and FIG. 6 together, when the first display data and the second display data have identical polarity and have similar data, the control circuit 270 sets the first display data to be output at the predetermined falling edge of the LD signal and sets the second display data to be output at the falling edge of the mask LD signal (step S660). When the first display data and the second display data have different polarity and/or have dissimilar data, the control circuit 270 sets both the first display data and the second display data to be output at the falling edges of the LD signal (step S670). In the case that the pulse width of the mask LD signal is long enough (determined by the designer), the operating manner shown in FIG. 6 may also be used to prevent the source voltage from being interfered.

It is noted that, in more other embodiments, a time point of the rising edge of the mask LD signal may be after a time point of the rising edge of the LD signal. when the first display data and the second display data have identical polarity and have similar data, the control circuit 270 sets the first display data to be output at the rising edge of the LD signal and sets the second display data to be output at the rising edge of the mask LD signal. When the first display data and the second display data have different polarity and/or have dissimilar data, the control circuit 270 sets both the first display data and the second display data to be output at the rising edges of the LD signal In some embodiments, the control circuit is configured to control the second display data to be output to the data line at a first transition edge of a data output control signal when the second display data is similar to the first display data; and control the second display data to be output to the data line at a second transition edge of the data output control signal when the second display data is dissimilar to the first display data, wherein the first transition edge of the data output control signal occurs later than the second transition edge of the pulse of the data output control signal.

The data output control signal may be a load (LD) signal for indicating a time point for the data channel to transmit display data to be displayed on each line of the display panel.

In some embodiments, different types of edges of the same data output control signal can be used to trigger display data to be output. More specifically, the first transition edge of the data output control signal can be a falling/rising edge of the data output control signal, and the second transition edge of the data output control signal can be a rising/falling edge of the same data output control signal.

In some embodiments, the same or different types of edges of different data output control signals can be used to trigger display data to be output. More specifically, the data output control signal can include a first data output control signal and a second data output control signal.

The first data output control signal may be a load (LD) signal for indicating a time interval for the data channel to transmit display data to be displayed on each line of the display panel, and the second data output control signal may be a mask LD signal generated by making the LD signal.

The control circuit can be further configured to control the second display data to be output to the data line at a rising/falling edge of the first data output control signal when the second display data is similar to the first display data, and control the second display data to be output to the data line at a rising/falling edge of the second data output control signal when the second display data is dissimilar to the first display data, wherein the rising/falling edge of the first data output control signal occurs later than the rising/falling edge of the second data output control signal.

Figure 7:
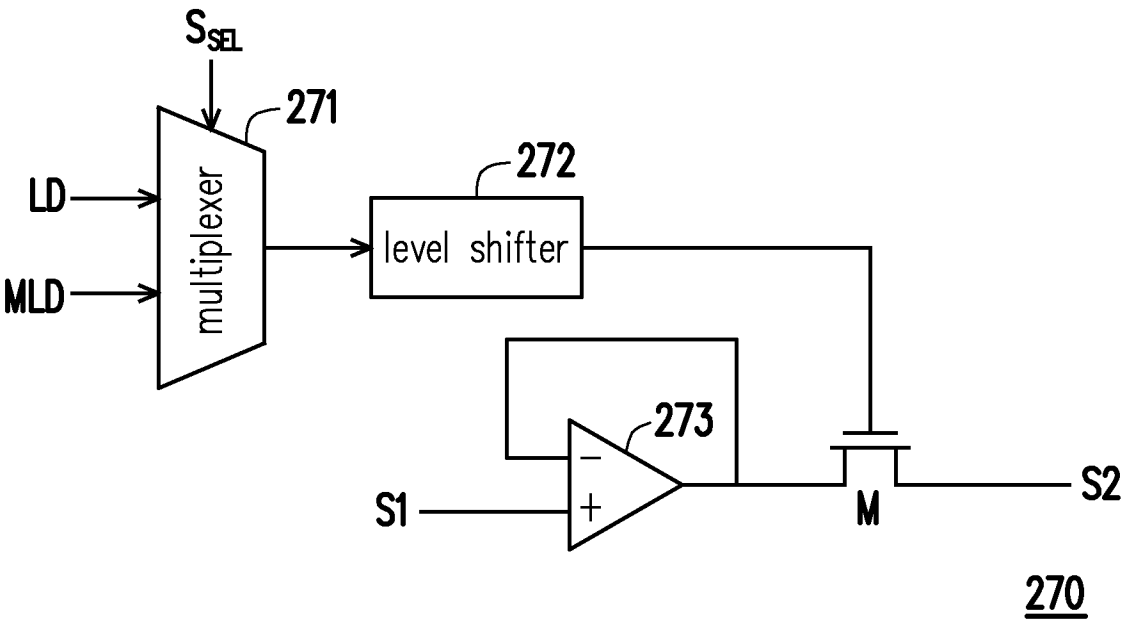
FIG. 7 is a schematic diagram illustrating blocks of a control circuit according to an embodiment of the disclosure.

FIG. 7 is a schematic diagram illustrating blocks of a control circuit according to an embodiment of the disclosure. With reference to FIG. 7, the control circuit 270 includes a multiplexer 271, a level shifter 272, an amplifier 273, and a switch M. The multiplexer 271 may select between a LD signal LD and a mask LD signal MLD to be output to act as an output signal according to a signal SSEL (indicating the result determined in step S550 in FIG. 5 or in step S650 in FIG. 6). The multiplexer 271 belongs to a digital circuit, and the switch M belongs to an analog circuit, and the level shifter 272 is therefore required to convert a first (e.g., low) voltage into a second (e.g., high) voltage, so that the switch M may be turned on due to an increase in voltage. A non-inverting input terminal of the amplifier 273 receives an input signal S1 indicating the display data, and an output signal of an output terminal of the amplifier 273 is fed back to an inverting input terminal of the amplifier 273 to act as an input signal of the non-inverting input terminal. The output signal of the amplifier 273 is transmitted to a first terminal of the switch M, and a time point that the output signal of the amplifier 273 is transmitted to a second terminal of the switch M to act as an output signal S2 (i.e., an input signal of the output buffer 280 shown in FIG. 2) is determined according to an output signal of the level shifter 272. Accordingly, the control circuit 270 may determine whether to delay the output time point at which the second display data is output according to the result determined in step S450 in FIG. 4, step S550 in FIG. 5, or step S650 in FIG. 6. It is noted various implementations can be made to turn on or off and output path of the data channel according to a switch control signal. The switch control signal can be generated so as to cause the delay time, for example by using the switch control signal to control a switch and delay a starting point of an on-state of the switch for the delay time.

Figure 8:
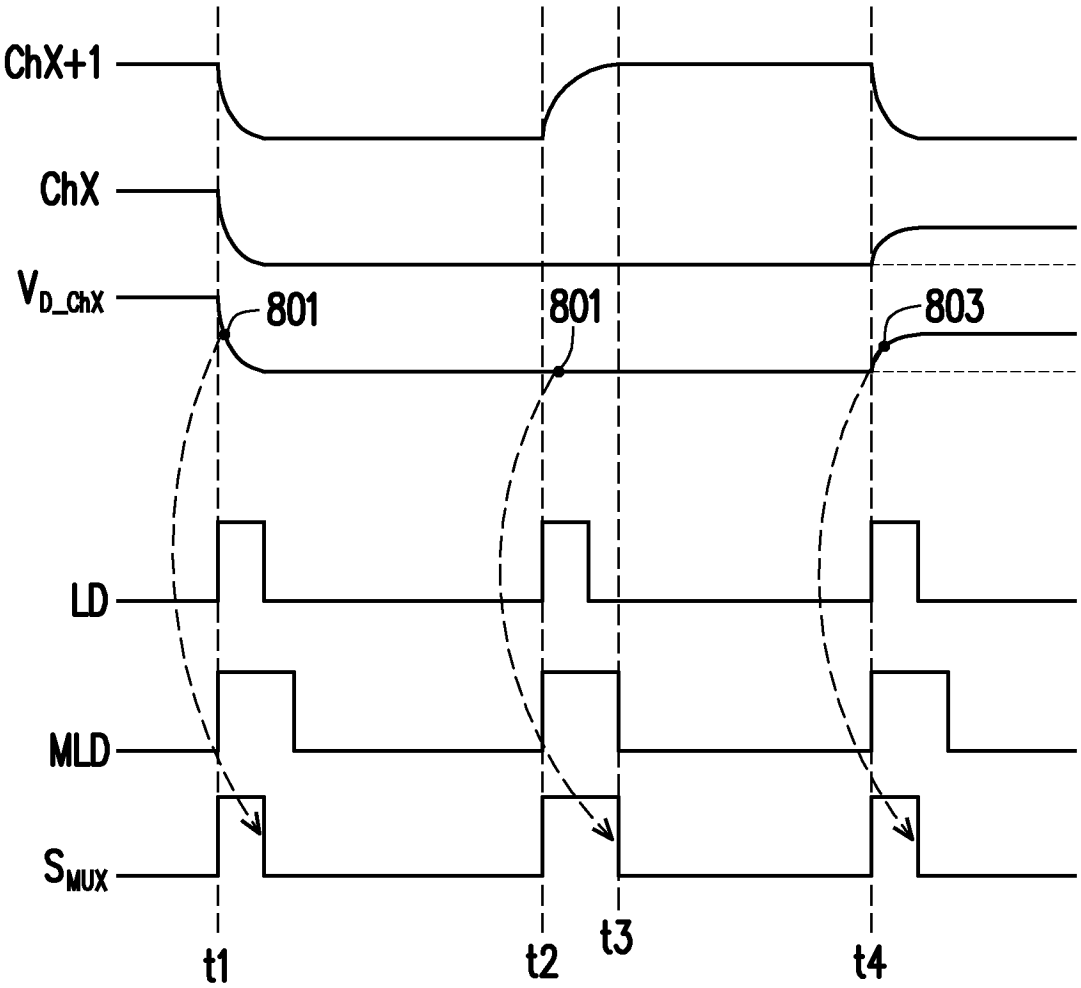
FIG. 8 is a schematic diagram illustrating signal waveforms of the source driving circuit according to an embodiment of the disclosure.

FIG. 8 is a schematic diagram illustrating signal waveforms of the source driving circuit according to an embodiment of the disclosure. With reference to FIG. 8, CHX represents an actual output signal of an $X^{th}$ data channel, and CHX+1 represents an actual output signal of an $X+1^{th}$ data channel, where X is a positive integer. $V_{D_CHX}$ represents a voltage signal to be transmitted through the $X^{th}$ data channel, LD represents the LD signal, MLD represents the mask LD signal, and $S_{MUX}$ represents an output signal of the multiplexer. As shown in FIG. 8, the output signal CHX+1 corresponding to the second display data is transited in a period between time points t2 and t3, and the output signal CHX of the adjacent $X+1^{th}$ data channel does not change in the period between the time points t2 and t3. Therefore, in the disclosure, the source driving circuit may control a data voltage at a point 801 to be output at the falling edge of the mask LD signal MLD through comparing between the display data at the point 801 (the first display data) and a previous display data (i.e., the first display data). The LD signal LD and the mask LD signal MLD are selectively provided to trigger the display data to be loaded or output to the corresponding data line. The multiplexer selects the mask LD signal MLD to be output at the time point t2 as in step S660 in FIG. 6 according to an instruction such as the control signal of the result determined in step S650 in FIG. 6 (see the output signal $S_{MUX}$), so that the output signal CHX may avoid the time period that the source voltage may be interfered. Incidentally, since the data voltage at a point 802 and a point 803 is transited, the multiplexer selects the LD signal LD to be output at the time points t1 and t4 as in step S670 in FIG. 6 according to an instruction such as the control signal of the result determined in step S650 in FIG. 6, so that the source driving circuit does not delay the output time point at which the data voltage is output.

In view of the foregoing, in the disclosure, the first display data and the second display data are compared, so that the output time point at which the second display data is output may be delayed when the first display data and the second display data are similar according to the difference therebetween. In this way, the time point at which the second display data is output may avoid the time period during which the source voltage may be interfered. In addition, regarding the crosstalk interference problem in the display screen, in the disclosure, since the binding point manner used to increase the gamma reference voltage in the related art is not adopted, the problem of an increase in analog power consumption is prevented from occurring.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A source driving circuit, adapted to a display panel, the source driving circuit comprising:

a data channel, configured to be coupled to a data line of the display panel and drive the data line of the display panel sequentially according to a first display data and a second display data, wherein the first display data corresponds to a first scan line of the display panel, and the second display data corresponds to a second scan line of the display panel next to the first scan line of the display panel; and a control circuit, coupled to the data channel and configured to control a time point that the data channel outputs the second display data according to similarity between the first display data and the second display data, wherein the control circuit is configured to:

control the second display data to be output to the data line at a first transition edge of a data output control signal when the second display data is similar to the first display data; and control the second display data to be output to the data line at a second transition edge of the data output control signal when the second display data is dissimilar to the first display data, wherein the first transition edge of the data output control signal occurs later than the second transition edge of the pulse of the data output control signal.

2. The source driving circuit according to claim 1, wherein the control circuit is configured to delay the time point for a delay time when the second display data is identical or similar to the first display data.

3. The source driving circuit according to claim 1, wherein during the delay time, the control circuit is configured to cause an output terminal of the data channel to be in a floating state.

4. The source driving circuit according to claim 1, wherein a time length of the delay time is fixed when the first display data and the second display data are similar.

5. The source driving circuit according to claim 1, wherein a time length of the delay time depends upon similarity degree between the second display data and the first display data.

6. A source driving circuit, adapted to a display panel, the source driving circuit comprising:

a data channel, configured to be coupled to a data line of the display panel and drive the data line of the display panel sequentially according to a first display data and a second display data, wherein the first display data corresponds to a first scan line of the display panel, and the second display data corresponds to a second scan line of the display panel next to the first scan line of the display panel; and a control circuit, coupled to the data channel and configured to determine whether to cause a delay time for delaying a time point that the data channel outputs the second display data according to similarity between the second display data and the first display data, wherein the control circuit is configured to:

control the second display data to be output to the data line at a first transition edge of a data output control signal when the second display data is similar to the first display data; and control the second display data to be output to the data line at a second transition edge of the data output control signal when the second display data is dissimilar to the first display data, wherein the first transition edge of the data output control signal occurs later than the second transition edge of the pulse of the data output control signal.

7. The source driving circuit according to claim 6, wherein each of the first display data and the second display data comprises a polarity and a bit value respectively, and the control circuit is configured to determine the similarity between the second display data and the first display data based on a polarity identically of the second display data and the first display data, and a bit value similarity between the second display data and the first display data.

8. The source driving circuit according to claim 7, wherein the control circuit is configured to determine that the second display data is similar to the first display data when an amount of the same bit values of the first display data and the second display data is equal to or greater than a threshold and the polarity of the second display data is identical to the polarity of the first display data.

9. The source driving circuit according to claim 6, wherein the control circuit is further configured to perform to cause the delay time when the second display data is similar to the first display data, and the control circuit is further configured not to perform to cause the delay time when the second display data is dissimilar to the first display data.

10. The source driving circuit according to claim 6, wherein the data output control signal is a load (LD) signal for indicating a time point for the data channel to transmit display data to be displayed on each line of the display panel.

11. The source driving circuit according to claim 6, wherein the first transition edge of the data output control signal is a falling/rising edge of the data output control signal, and the second transition edge of the data output control signal is a rising/falling edge of the data output control signal.

12. The source driving circuit according to claim 6, wherein the data output control signal comprises a first data output control signal and a second data output control signal.

13. The source driving circuit according to claim 12, wherein the first data output control signal is a load (LD) signal for indicating a time interval for the data channel to transmit display data to be displayed on each line of the display panel, and the second data output control signal is a mask LD signal generated by making the LD signal.

14. The source driving circuit according to claim 12, wherein the control circuit is further configured to:

control the second display data to be output to the data line at a rising/falling edge of the first data output control signal when the second display data is similar to the first display data; and control the second display data to be output to the data line at a rising/falling edge of the second data output control signal when the second display data is dissimilar to the first display data, wherein the rising/falling edge of the first data output control signal occurs later than the rising/falling edge of the second data output control signal.

15. The source driving circuit according to claim 6, wherein during the delay time, the control circuit is configured to cause an output terminal of the data channel to be in a floating state.

16. The source driving circuit according to claim 15, wherein the data channel comprises:

an amplifier, configured to sequentially output a first driving voltage indicated by the first display data and a second driving voltage indicated by the second display data; and a switch, configured to be coupled between the amplifier and the output terminal of the data channel to be turned on or off according to a switch control signal, wherein the control circuit is configured to generate the switch control signal and perform to cause the delay time by using the switch control signal to delay a starting point of an on-state of the switch for the delay time.

17. The source driving circuit according to claim 16, wherein the control circuit comprises a multiplexer, configured to select one of a first data output control signal and a second data output control signal as the switch control signal according to the similarity between the second display data and the first display data, wherein a rising/falling edge of the first data output control signal occurs later than a rising/falling edge of the second data output control signal.

18. An operation method of a source driving circuit, wherein the source driving circuit is adapted to a display panel, the operation method comprising:

driving the data line of the display panel sequentially according to a first display data and a second display data, wherein the first display data corresponds to a first scan line of the display panel, and the second display data corresponds to a second scan line of the display panel next to the first scan line of the display panel;

determining whether to cause a delay time for delaying a time point outputting the second display data according to similarity between the second display data and the first display data;

controlling the second display data to be output to the data line at a first transition edge of a data output control signal when the second display data is similar to the first display data; and controlling the second display data to be output to the data line at a second transition edge of the data output control signal when the second display data is dissimilar to the first display data, wherein the first transition edge of the data output control signal occurs later than the second transition edge of the pulse of the data output control signal.

19. The operation method of the source driving circuit according to claim 18, wherein each of the first display data and the second display data comprises a polarity and a bit value respectively, the operation method further comprising:

determining the similarity between the second display data and the first display data based on a polarity identicality of the second display data and the first display data, and a bit value similarity between the second display data and the first display data.

20. The operation method of the source driving circuit according to claim 19, further comprising:

determining that the second display data is similar to the first display data when an amount of the same bit values of the first display data and the second display data is equal to or greater than a threshold and the polarity of the second display data is identical to the polarity of the first display data.

21. The operation method of the source driving circuit according to claim 18, further comprising:

performing to cause the delay time when the second display data is similar to the first display data, and not to perform to cause the delay time when the second display data is dissimilar to the first display data.

22. The operation method of the source driving circuit according to claim 18, wherein the data output control signal is a load (LD) signal for indicating a time point for a data channel to transmit display data to be displayed on each line of the display panel.

23. The operation method of the source driving circuit according to claim 18, wherein the first transition edge of the data output control signal is a falling/rising edge of the data output control signal, and the second transition edge of the data output control signal is a rising/falling edge of the data output control signal.

24. The operation method of the source driving circuit according to claim 18, wherein the data output control signal comprises a first data output control signal and a second data output control signal.

25. The operation method of the source driving circuit according to claim 24, wherein the first data output control signal is a load (LD) signal for indicating a time interval for a data channel to transmit display data to be displayed on each line of the display panel, and the second data output control signal is a mask LD signal generated by making the LD signal.

26. The operation method of the source driving circuit according to claim 24, further comprising:

controlling the second display data to be output to the data line at a rising/falling edge of the first data output control signal when the second display data is similar to the first display data; and controlling the second display data to be output to the data line at a rising/falling edge of the second data output control signal when the second display data is dissimilar to the first display data, wherein the rising/falling edge of the first data output control signal occurs later than the rising/falling edge of the second data output control signal.

27. The operation method of the source driving circuit according to claim 18, further comprising:

causing an output terminal of a data channel to be in a floating state during the delay time.

28. The operation method of the source driving circuit according to claim 27, further comprising:

sequentially outputting a first driving voltage indicated by the first display data and a second driving voltage indicated by the second display data;

turning on or off and output path of the data channel according to a switch control signal, wherein the switch control signal is generated so as to cause the delay time by using the switch control signal to delay a starting point of an on-state of the switch for the delay time.

29. The operation method of the source driving circuit according to claim 27, further comprising:

selecting one of a first data output control signal and a second data output control signal as the switch control signal according to the similarity between the second display data and the first display data, wherein a rising/falling edge of the first data output control signal occurs later than a rising/falling edge of the second data output control signal.

* * * * *